US008371683B2

(12) United States Patent
Paschkewitz et al.

(10) Patent No.: US 8,371,683 B2
(45) Date of Patent: Feb. 12, 2013

(54) PARTICLE REMOVAL DEVICE FOR INK JET PRINTER

(75) Inventors: John Steven Paschkewitz, San Carlos, CA (US); Eric J. Shrader, Belmont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 203 days.

(21) Appl. No.: 12/977,598

(22) Filed: Dec. 23, 2010

(65) Prior Publication Data

US 2012/0162309 A1 Jun. 28, 2012

(51) Int. Cl.
*B41J 2/165* (2006.01)

(52) U.S. Cl. ..... 347/85

(58) Field of Classification Search ..... None
See application file for complete search history.

(56) References Cited

U.S. PATENT DOCUMENTS

| | | | |
|---|---|---|---|
| 4,995,940 | A | 2/1991 | Hine et al. |
| 5,030,973 | A | 7/1991 | Nonoyama et al. |
| 5,107,281 | A | 4/1992 | Takahashi |
| 5,427,663 | A | 6/1995 | Austin et al. |
| 5,489,930 | A | 2/1996 | Anderson |
| 5,701,148 | A | 12/1997 | Moynihan et al. |
| 5,734,399 | A | 3/1998 | Weber et al. |
| 6,007,188 | A | 12/1999 | MacLeod et al. |
| 6,398,850 | B1 | 6/2002 | Field et al. |
| 6,457,821 | B1 | 10/2002 | Liu et al. |
| 6,506,609 | B1 | 1/2003 | Wada et al. |
| 6,511,157 | B1 | 1/2003 | Yoshimura et al. |
| 7,150,812 | B2 | 12/2006 | Huang et al. |
| 7,201,476 | B2 | 4/2007 | Buchanan et al. |
| 7,247,274 | B1 | 7/2007 | Chow |
| 7,273,275 | B2 | 9/2007 | Buchanan et al. |
| 7,357,499 | B2 | 4/2008 | Kim |
| 7,637,598 | B2 | 12/2009 | Conta et al. |
| 7,735,652 | B2 | 6/2010 | Inglis et al. |
| 7,735,954 | B2 | 6/2010 | Xu et al. |
| 2004/0165047 | A1 | 8/2004 | Takata |
| 2007/0002108 | A1 | 1/2007 | Sugahara |

OTHER PUBLICATIONS

EP Search Report and Written Opinion dated Apr. 3, 2012 from EP Application No. 1193940.1, 8 pages.
Choi et al., "Continuous Blood Cell Separation by Hydrophoretic Filtration", Lab on a Chip, vol. 7, Aug. 10, 2007, pp. 1532-1538.

(Continued)

*Primary Examiner* — Matthew Luu
*Assistant Examiner* — Alejandro Valencia
(74) *Attorney, Agent, or Firm* — Hollingsworth Davis, LLC

(57) ABSTRACT

A particle removal device for an ink jet printer is discussed. The particle removal device includes a first separator comprising an arrangement of obstacles including at least two rows of obstacles that extend laterally with respect to a flow path of ink in the first separator. The rows of obstacles are offset from one another by a row offset fraction. The arrangement of obstacles is configured to preferentially route larger particles having diameters greater than a critical diameter through the arrangement and along a first trajectory vector that is angled with respect to the direction of the flow path of the ink. The angle of the first trajectory vector with respect to the ink flow path is a function of the row offset fraction. Smaller particles having diameters less than the critical diameter travel through the arrangement along a second trajectory vector that is not substantially angled with respect to the flow path of the ink. The first separator causes a pressure drop of the ink of less than about 100 Pa.

13 Claims, 13 Drawing Sheets

OTHER PUBLICATIONS

Diaz et al., "Microscopic Origin of Magnetostriction in FeCoB Amorphous Alloys Studied by Differential EXAFS", ESRF, Aug. 12, 2008, 11 pages.
Davis et al., "Deterministic Hydrodynamics: Taking Blood Apart", PNAS, vol. 103, No. 40, Oct. 3, 2006, pp. 14779-14784.
Loutherback et al., "Improved Performance of Deterministic Lateral Displacement Arrays with Triangular Posts", Springer, May 21, 2010, 7 pages.
Huh et al., "A Gravity Driven Microfluidic Particle Sorting Device with Hydrodynamic Separation Amplification", Analytical Chemistry, vol. 79(4), Feb. 15, 2007, pp. 1369-1376.
Inglis et al., "Critical Particle Size for Fractionation by Deterministic Lateral Displacement", Lab on a Chip, vol. 6, Mar. 17, 2006, pp. 655-658.
Jain et al., "Particle Dispersion and Separation Resolution of Pinched Flow Fractionation", Analytical Chemistry, vol. 80, No. 5, Mar. 1, 2008, pp. 1641-1648.
Yeom et al., "Low Reynolds Number Flow Across an Array of Cylindrical Microposts in a Microchannel and Figure-of-Merit Analysis of Micropost-Filled Microreactors", Journal of Microcmechanical Microengineering, vol. 19, May 22, 2009, 10 pages.
Scott, "Contraction/Expansion Flow of Dilute Elastic Solutions in Microchannels", Jun. 2004, 154 pages.

PARTICLE REMOVAL DEVICE FOR INK JET PRINTER

FIELD

The present disclosure relates generally to methods and devices useful for ink jet printing.

SUMMARY

Embodiments discussed in the disclosure are directed to methods and devices used in ink jet printing. For example, some embodiments involve a particle removal device for an ink jet printer. The particle removal device includes a first separator comprising an arrangement of obstacles including at least two rows of obstacles. Each of the obstacles extends laterally with respect to a flow path of ink in the first separator. The rows of obstacles are offset from one another by a row offset fraction. The arrangement of obstacles is configured to preferentially route larger particles having diameters greater than a critical diameter through the arrangement and along a first trajectory vector that is angled with respect to the direction of the flow path of the ink. The angle of the first trajectory vector with respect to the ink flow path is a function of the row offset fraction. The arrangement of obstacles is configured to route smaller particles having diameters less than the critical diameter through the arrangement along a second trajectory vector that is not substantially angled with respect to the flow path of the ink. The first separator causes a pressure drop of the ink of less than about 100 Pa.

In some cases, the row offset fraction is in a range of about 0.1 to about 0.25. In some cases, the critical diameter is in a range of about 10 μm to about 20 μm. In some cases, the cross sectional dimension of the obstacles is about 25 μm. In some cases, the gap between obstacles in a row is greater than about 1.5 times the critical diameter.

In some implementations, a second separator is fluidically coupled to the first separator, the second separator includes a pinched flow fractionation feature configured to further separate the larger particles from the smaller particles. For example, the second separator can include a converging feature and a diverging feature. The second separator may include one or more focusing inlets configured to allow a portion of ink that is substantially free of the larger particles flowing in a second channel to provide a sheath liquid that joins ink that includes the larger particles flowing in a first channel.

Some embodiments involve a particle removal device for an ink jet printer. The particle removal device includes at least one separator that comprises a first channel and a second channel and an arrangement of obstacles. The arrangement of obstacles includes at least about two and not more than about ten rows of obstacles. Each of the obstacles extends laterally with respect to a flow path of ink. The rows of obstacles are offset from one another by an offset fraction. The arrangement of obstacles is configured to route larger particles having diameters greater than a critical diameter through the arrangement into the first channel along trajectory vector that is angled with respect to the flow path of the ink and to route smaller particles having diameters less than a critical diameter through the arrangement and into the first channel and the second channel. In come implementations, the pressure drop in the separator is less than about 100 Pa.

Some embodiments involve a layered device for separating particles from ink. The layered device includes a base layer and a layered stack disposed on the base layer. The layered stack forms a separator that includes a first channel, a second channel, and an arrangement of bars comprising at least two rows of bars. The bars extend laterally with respect to a flow path of the ink in the separator and the rows of bars are offset from one another by an offset fraction. The arrangement of bars is configured to preferentially route larger particles having diameters greater than a critical diameter through the arrangement into the first channel along a first trajectory vector that is angled with respect to the flow path of the ink, the angle of the first trajectory vector being a function of the offset fraction. The arrangement of bars is configured to route smaller particles having diameters smaller than the critical diameter into the first channel or the second channel along a second trajectory vector that is not substantially angled with respect to the flow path of the ink.

In some cases, the arrangement is configured to maintain a pressure drop of the ink of less than about 100 Pa in the separator. In some cases, the arrangement includes between about 2 and about 10 rows of bars. In some cases, the particles are air bubbles.

Some embodiments involve methods of making devices for removing particles from ink in an ink jet printer. One such method involves forming multiple layers of a multi-layer stack and attaching each of the multiple layers to an adjacent layer. Each layer of the multi-layer stack forms at least one of bar of an arrangement of bars. The arrangement of bars forms a separator that includes at least two rows of bars, the bars extending laterally across the separator. The rows of bars are offset from one another by an offset fraction. The arrangement of bars is configured to route smaller particles through the arrangement along a second trajectory vector and to preferentially route larger particles through the arrangement along a first trajectory vector that is a function of the offset fraction.

In some implementations, the multiple layers are formed by one or more of chemical etching, laser cutting, punching, machining, and printing. In some implementations, the multiple layers are attached by one or more of diffusion bonding, plasma bonding, adhesives, welding, chemical bonding, and mechanical joining.

Embodiments involve an ink jet printer that includes a particle remover. The ink jet printer includes ink jets configured to selectively eject ink toward a print medium according to predetermined pattern, a transport mechanism configured to provide relative movement between the print medium and the print head, and a particle remover configured to remove particles from the ink before the ink enters the jets. The particle remover includes a first separator comprising a first channel, a second channel, and an arrangement of obstacles including at least two rows of obstacles. Each of the obstacles extends laterally with respect to ink flow within the first separator, the rows of obstacles offset from one another by a row shift fraction. The arrangement of obstacles is configured to route larger particles through the arrangement along a first trajectory vector and into the first channel. The first trajectory vector is a function of the row shift fraction. The dimensions of the particle remover are configured to cause a pressure drop of the ink of less than about 100 Pa.

In some cases, the particle remover may include multiple separators. For example, a second separator may be coupled to the first separator. The separator can include converging and diverging features configured to successively converge and diverge a flow path of the larger particles flowing in the second channel. The second separator may also include focusing inlets configured to allow a portion of "clean" ink flowing in the second channel to provide a sheath liquid that joins the contaminated ink flowing in the first channel. In some implementations, a displacement distance of the larger particles caused by the offset rows within the first separator is between about 50 μm and about 500 μm.

DESCRIPTION OF VARIOUS EMBODIMENTS

Figure 1:
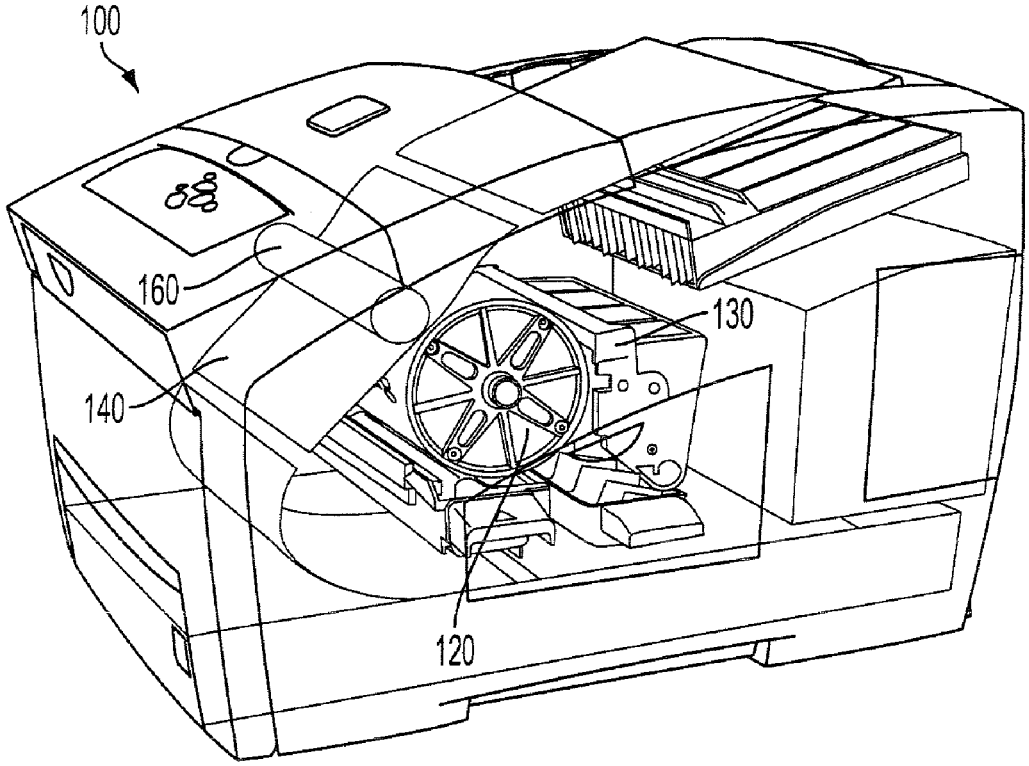
FIGS. 1 and 2 provide internal views of portions of an ink jet printer that incorporates a particle removal device.

Ink jet printers operate by ejecting small droplets of liquid ink onto print media according to a predetermined pattern. In some implementations, the ink is ejected directly on a final print media, such as paper. In some implementations, the ink is ejected on an intermediate print media, e.g. a print drum, and is then transferred from the intermediate print media to the final print media. Some ink jet printers use cartridges of liquid ink to supply the ink jets. Solid ink printers have the capability of using a phase change ink which is solid at room temperature and is melted before being jetted onto the print media surface. Inks that are solid at room temperature advantageously allow the ink to be transported and loaded into the ink jet printer in solid form, without the packaging or cartridges typically used for liquid inks. In some implementations, the solid ink is melted in a page-width print head which jets the molten ink in a page-width pattern onto an intermediate drum. The pattern on the intermediate drum is transferred onto paper through a pressure nip.

In the liquid state, ink may contain bubbles and/or particles that can obstruct the passages of the ink jet pathways. For example, bubbles can form in solid ink printers due to the freeze-melt cycles of the ink that occur as the ink freezes when printer is powered down and melts when the printer is powered up for use. As the ink freezes to a solid, it contracts, forming voids in the ink that are subsequently filled by air. When the solid ink melts prior to ink jetting, the air in the voids can become bubbles in the liquid ink. Particles in the ink may be introduced into the ink when they flake off of materials used to form the ink flow path. As discussed herein, the term "particle" is used to describe any unwanted matter in the ink, including bubbles.

Particles in the ink jet pathways can cause misplaced, intermittent, missing or weak ink jetting resulting in undesirable visual flaws in the final printed pattern. Some ink jet printers pass the ink through filters, flow breathers, buoyancy-based separators or other devices to prevent particles from reaching the jet region of the print head. However, these techniques present several problems. Filtering is non-optimal because filters can become clogged over the operational life of the printer. Significant engineering is required to ensure that coalesced particles do not clog the filter. Additionally, filter elements block the ink flow to some extent and induce a pressure drop penalty that may be undesirable in print head operation. This pressure drop is exacerbated as the filter surface becomes covered with particles that have been filtered from the ink. Flow breathers have been used to remove bubbles, but add complexity to the print head design. Devices that rely on the buoyancy of bubbles increase the bulk of the print head. The characteristic rise velocities of small bubbles, i.e., on the scale of the print head orifices, are very small and the resulting separation times can be large. As a result, dedicated volumes are required for the separator elements, increasing print head size.

Embodiments described in this disclosure involve approaches for removing particles from the ink of an ink jet printer. Some approaches discussed in this disclosure involve the use of obstacle arrays and/or other separation elements as a means to separate particles from ink. The obstacle array causes particles of different sizes to follow different predetermined trajectory paths through the obstacle array. As the particles travel through the obstacle array, particles that are below than a critical size are separated from particles that are above the critical size. The particles that are above the critical diameter follow a first trajectory vector through the array that is angled with respect to the ink flow path. The particles that are below the critical size follow a zigzag path through the array along a second trajectory vector that is substantially parallel to the ink flow. The particles flowing along the first trajectory can be collected in a first channel and the particles flowing along the second trajectory can be collected in a second channel, thus separating the larger particles from the ink that flows to the ink jets.

Figure 2:
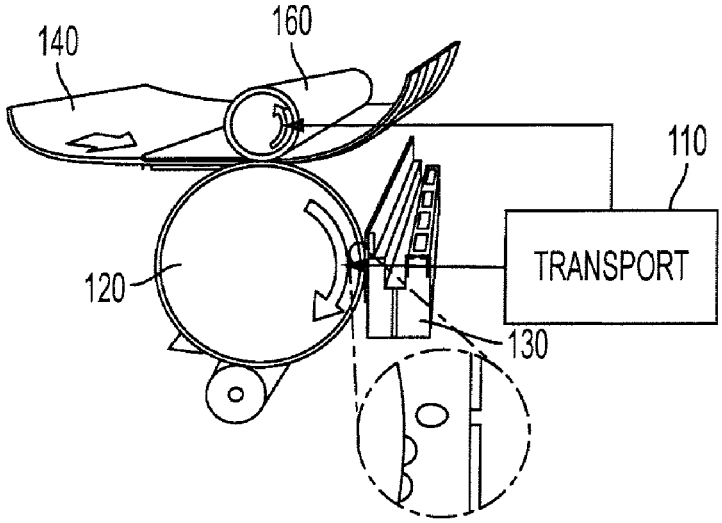

FIGS. 1 and 2 provide internal views of portions of an ink jet printer 100 that incorporates a particle removal device as discussed herein. The printer 100 includes a transport mechanism 110 that is configured to move the drum 120 relative to the print head 130 and to move the paper 140 relative to the drum 120. The print head 130 may extend fully or partially along the length of the drum 120 and includes a number of ink jets. As the drum 120 is rotated by the transport mechanism 110, ink jets of the print head 130 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 3:
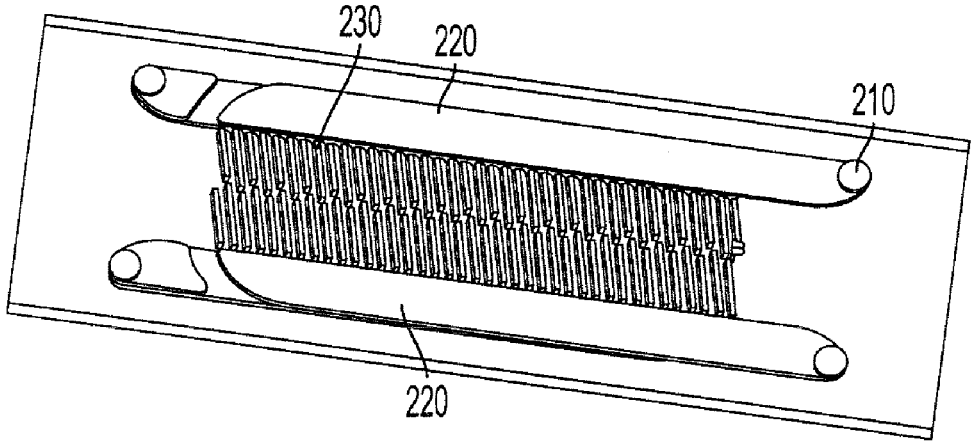
FIGS. 3 and 4 show views of an exemplary print head.
Figure 4:
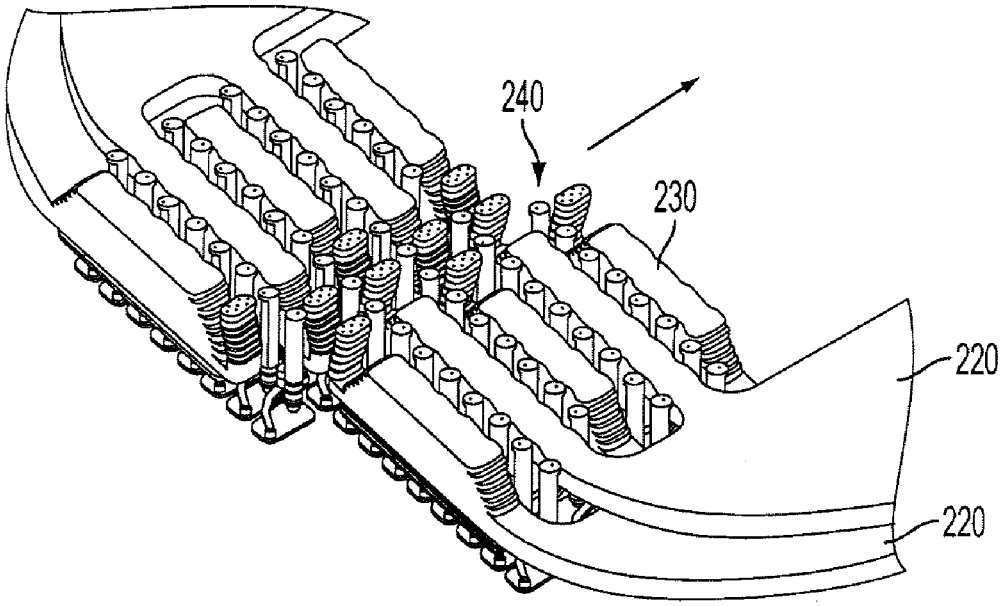

FIGS. 3 and 4 show more detailed views of an exemplary print head. The path of molten ink, contained initially in a reservoir, flows through a port 210 into a main manifold 220 of the print head. As best seen in FIG. 4, in some cases, there are four main manifolds 220 which are overlaid, one manifold 220 per ink color, and each of these manifolds 220 connects to interwoven finger manifolds 230. The ink passes through the finger manifolds 230 and then into the ink jets 240. The manifold and ink jet geometry illustrated in FIG. 4 is repeated in the direction of the arrow to achieve a desired print head length, e.g. the full width of the drum.

Figure 5:
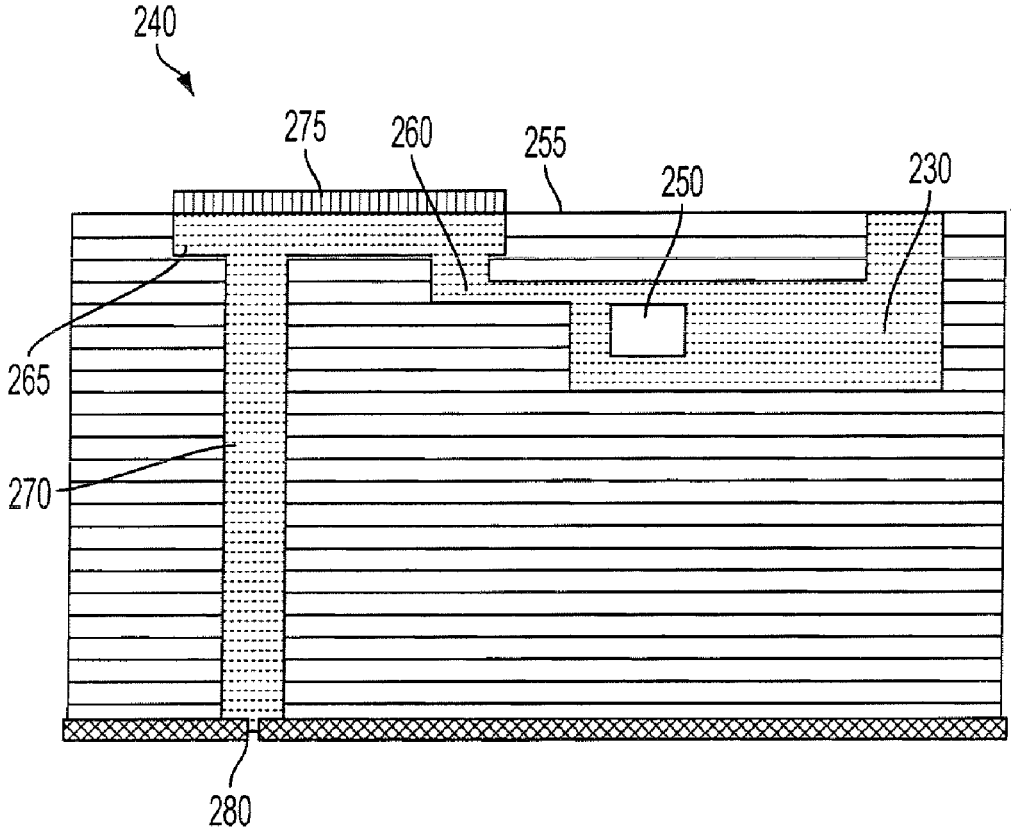
FIG. 5 provides a view of a finger manifold and ink jet which shows a possible location for the particle removal device near the ink jet inlet between the finger manifold and the ink jet body.

In some examples discussed in this disclosure, the print head uses piezoelectric transducers (PZTs) for ink droplet ejection, although other methods of ink droplet ejection are known and such printers may also use a particle removal device as described herein. FIG. 5 provides a more detailed view of a finger manifold 230 and ink jet 240 which shows a possible location for the particle removal device 250 in the finger manifold 230. The particle removal device 250 may be located elsewhere, such as the main manifold, for example. The print head may include multiple particle removal devices positioned at one or more locations.

Activation of the PZT 275 causes a pumping action that alternatively draws ink into the ink jet body 265 and expels the ink through ink jet outlet 270 and aperture 280. The particle removal device 250 may include an arrangement of obstacles and/or other features that interact with the particles in the ink. The particle removal features can be used to control the flow paths of particles of various sizes. Most particles above a critical diameter can be diverted allowing "clean" ink that does not substantially include particles having diameters above the critical diameter to flow into the ink jet body 265.

Figure 6:
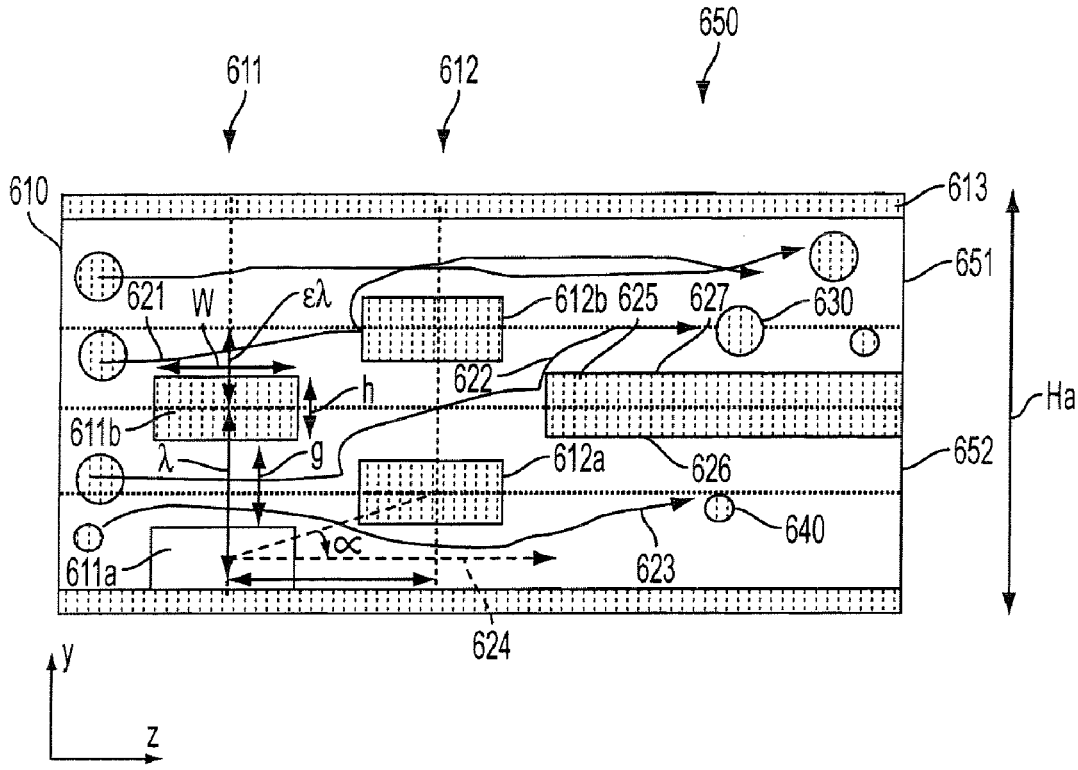
FIG. 6 illustrates a cross sectional view of a particle separator that includes an arrangement of obstacles.

FIG. 6 illustrates a cross sectional view of a particle removal device that includes a first separator 650. Ink which is contaminated with particles of various diameters, d, that are less than the gap distance, g, between the obstacles 611*a*, 611*b*, 612*a*, 612*b* flows in through the input side 610 of the separator 650. The particle-laden ink encounters an arrangement of obstacles 611*a*, 611*b*, 612*a*, 612*b* in the separator 650. The arrangement is configured to separate larger particles 630 having diameters that are greater than a critical diameter, $D_c$ from ink that does not substantially include the larger particles 630 and/or includes smaller particles 640 having diameters less than the critical diameter. The obstacles 611*a*, 611*b*, 612*a*, 612*b* in the separator 650 are arranged so that most of the larger particles 630 are diverted along a first trajectory path is angled with respect to the direction 624 of the ink flow path, but the smaller particles 640 follow a second trajectory path that zigzags between the obstacles and is substantially parallel to the direction 624 of the ink flow. The smaller particles are not substantially diverted and flow into both the first and the second channels 651, 652. The diversion of the larger particles along the angled trajectory causes a substantial number of the larger particles to migrate toward the first channel 651 of the separator 650. Ink that does not substantially include the larger particles and/or includes smaller particles 640 and fewer of the larger particles 630, flows in a second channel 652 of the separator 650. Thus, the concentration of the larger particles 630 in the first channel 651 is higher than the concentration of the larger particles 630 in the second channel 652.

The arrangement of obstacles 611*a*, 611*b*, 612*a*, 612*b* can be viewed as an array with rows 611, 612 and with a number of obstacles per row. In FIG. 6, the first row 611 encountered by the ink flow has two obstacles 611*a*, 611*b* and the second row 612 has two obstacles 612*a*, 612*b*. It will be understood that FIG. 6 is provided for illustrative purposes and more rows and/or more obstacles per row may be used. The rows 611, 612 are offset from one another by a row offset fraction, $\epsilon$. The row offset fraction, $\epsilon$, is the ratio of the distance that each subsequent row is shifted, $\epsilon\lambda$, divided by the array period, $\lambda$, (the distance between obstacles of a row) as illustrated in FIG. 6. The critical diameter, $D_c$, associated with particle separation can be determined as a function of the dimensions of the obstacles, width, w, and length, l, the gap distance between adjacent obstacles in a row, g, and the row offset fraction, $\epsilon$. In some cases, the gap, g, may be greater than about 1.5 times a diameter of the larger particles. In some cases, the row offset fraction is between 0.1 and 0.25.

If a particle has a diameter less than a critical diameter, $D_c$, the particle will follow a zigzag path through the arrangement of obstacles, as illustrated by the flow path 623 associated with particles 640. The zigzag path is along the direction 624 of the ink flow and is substantially parallel to the ink flow path through the separator 650. Particles 630, having a diameter greater than the critical diameter, $D_c$, will bump the obstacles 611*a*, 611*b*, 612*a*, 612*b* and follow angled trajectories along angle $\alpha$ as illustrated by flow paths 621 and 622.

After traveling through the array of obstacles 611*a*, 611*b*, 612*a*, 612*b*, the ink flowing in a first channel 651 of the separator 650 along a first side 627 of the elongated obstacle 625 includes relatively more of larger particles 630. The ink flowing in a second channel 652 of the separator along the second side 626 of the elongated obstacle 625 includes relatively fewer larger particles 630. In other words, the concentration of larger particles 630 is higher in the first channel than in the second channel. In some cases, the ink flowing in the second channel 652 may be substantially free of the larger particles 630. In this exemplary embodiment, the flow path of ink flowing in the first channel is aligned with the flow path of ink flowing in the second channel 652 by an elongated feature 625 at the output side 613 of the separator 650.

Figure 7:
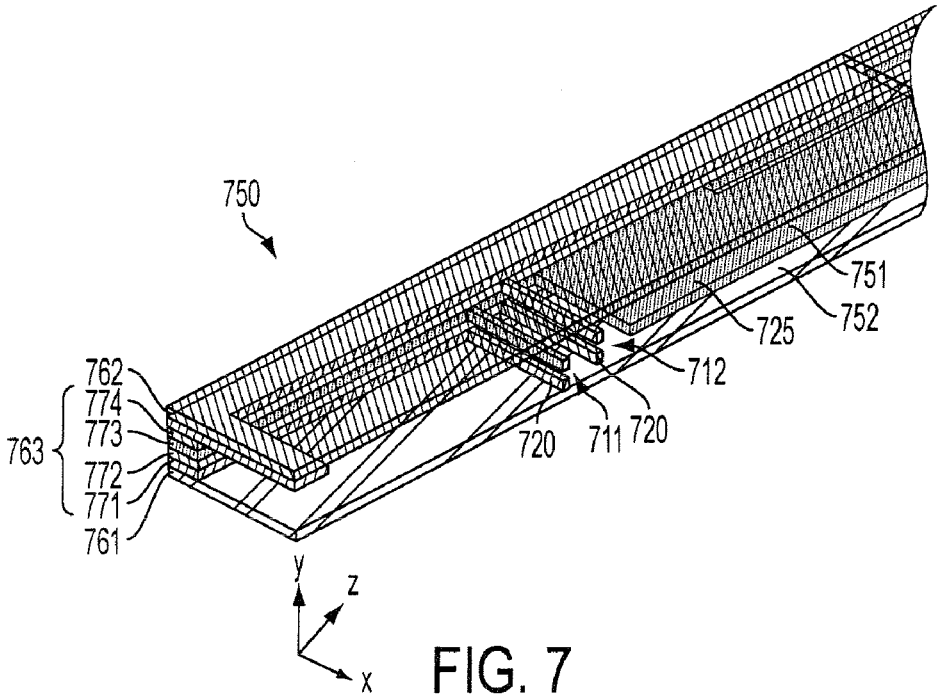
FIGS. 7 and 8 show isometric cutaway views of portions of a particle removal device including an obstacle array separator.
Figure 8:
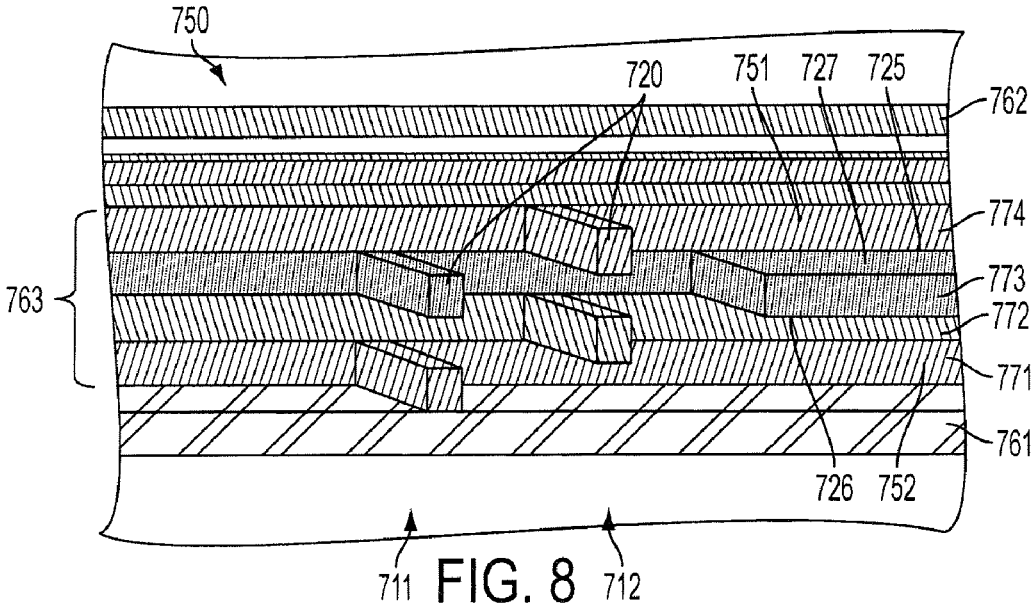

FIGS. 7 and 8 show isometric cutaway views of portions of a particle removal device that includes a separator 750 which is similar in some respects to the separator 650 illustrated in FIG. 6. In this exemplary implementation, the separator 750 is formed of multiple layers including a base layer 761, a cover layer 762 and a multi-layered stack 763. In the illustrated embodiment, the multi-layer stack includes four layers 771-774, each of the four layers 771-774 forming at least one obstacle 720 in an arrangement of obstacles within the separator 750. The arrangement of obstacles includes two rows 711, 712 of bars 720 that extend laterally along the x axis across the separator 750. Although the separator 750 illustrated in FIGS. 7 and 8 depicts one bar 720 per layer 771-774, it will be appreciated that alternate implementations may include more rows of bars, more bars per row, and/or more bars per layer than is depicted in FIGS. 7 and 8. The separator 750 includes an elongated obstacle 725 that separates the first channel 751 that carries the contaminated ink that contains larger particles from the second channel 752 that carries the "clean" ink which contains a smaller concentration of larger particles and/or does not include a substantial number of larger particles. In the example illustrated in FIGS. 7 and 8, the separated flow paths of the clean and contaminated ink are aligned in channels 752, 751 on either side of the elongated obstacle 725. The contaminated ink containing the higher concentration of larger particles flowing in the first channel 751 may be routed to a waste port and/or dump chamber (not shown), and/or may be subjected to additional particle removal processes.

Ink pressure in ink jet printers is typically on the order of about 500 Pascals (Pa) and a flow rate of about 0.25 g/sec to achieve appropriate jetting, and on the order of about 10 pounds per square inch (psi) and a flow rate of about 1 g/sec during purge operations. Ink jet applications cannot tolerate particle separators that cause excessive pressure drops that reduce ink pressure below a minimum pressure needed for jetting and/or purging. Pressure drops accompany each additional row of obstacles. The configuration of the particle separator device must be arranged to provide adequate particle separation without excessive decreases in pressure. The array design involves determining the obstacle dimensions and/or the number of rows and number of obstacles per row needed to achieve separation of particles greater than a critical size. This design is constrained by achieving ink pressure decreases within an acceptable range.

Figure 9:
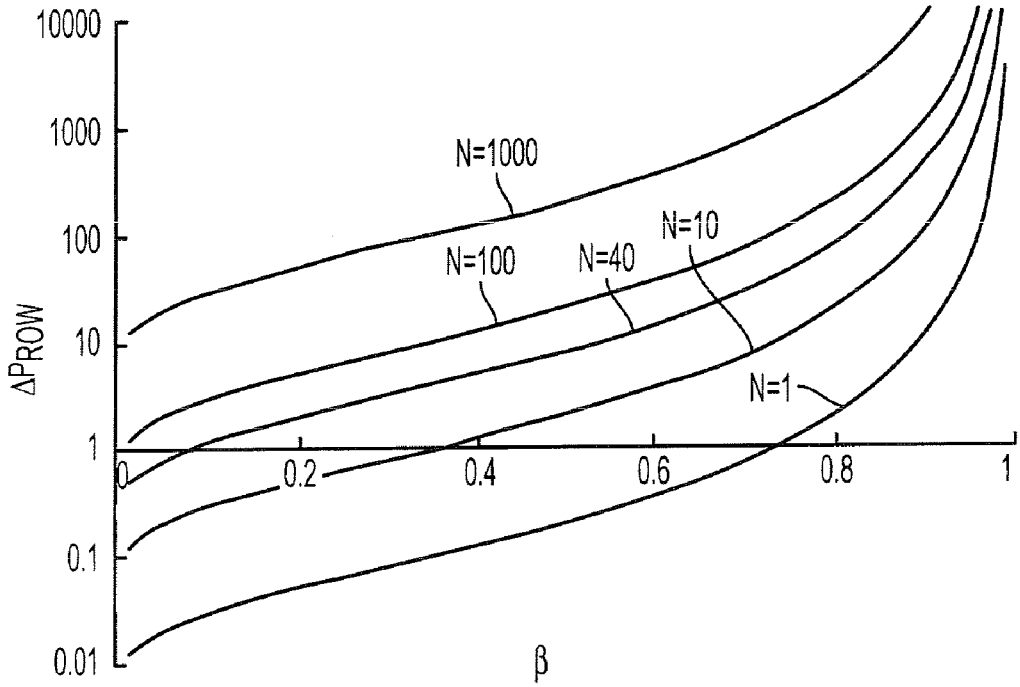
FIG. 9 illustrates the normalized pressure drop per row of obstacles as a function the geometrical configuration of the array.

In some cases, the particle removal device for an ink jet printer may include only one obstacle array comprising between about 2 to about 10 rows of obstacles with about 10 obstacles per row. For example, consider an array with circular obstacles having a radius a, and half spacing between the obstacles, $\lambda/2$. The blockage ratio is then $\beta=2a/\lambda$. FIG. 9 illustrates the normalized pressure drop per row ($\Delta P_{row}$) of obstacles as a function of $\beta$ and the number of obstacles in a row. FIG. 9 is a non-dimensional plot, and obtaining the pressure drop per row in Pascals may be calculated as, $\Delta P_{row}=\mu*U/2a$, where $\mu$ is the viscosity, U is velocity of the ink flow, and 2a is the diameter of the obstacles. FIG. 9 shows $\Delta P_{row}$ as a function of $\beta$, which is the ratio of the obstacle diameter to the array period (obstacle-to-obstacle spacing in a row). For an inlet 1 cm wide by 550 μm deep ($W_a$=1 cm, $H_a$=550 μm, see FIG. 11), using a printing flow rate of 0.25 g/sec, a row with 5, 25 micron diameter obstacles per row with a gap between obstacles of 25 microns has a pressure drop of about 5 Pa. Thus, about 16 rows of obstacles with 5 obstacles per row would remain within a pressure drop budget of about 100 Pa or less. Note that fewer rows and/or fewer obstacles per row for a given channel size may be used to achieve reduced pressure drops.

Figure 10:
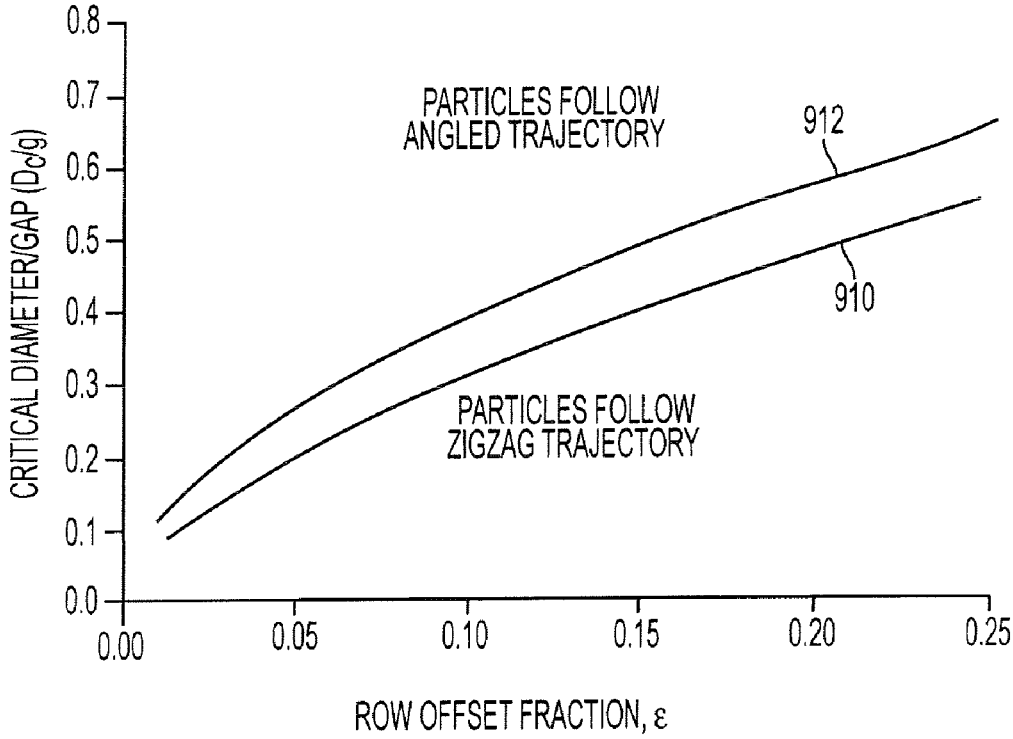
FIG. 10 graphically depicts theoretical relationships between the critical diameter/gap ratio and offset fraction.

The amount of displacement of particles greater than the critical size is determined by the array design. The displacement is the distance that a particle travels along the y axis along the angled trajectory to reach the first channel. For example, in some cases, the displacement may be between about 50 μm and about 550 μm. Although the bars 720 are illustrated in cross section as rectangular or square, they may have any cross sectional shape, e.g., circular, triangular, diamond shape, hexagonal, etc. It has been determined that the cross sectional obstacle shape may affect the relationship between the critical diameter/gap ratio (D/g) and the row shift fraction, $\epsilon$, as illustrated in FIG. 10. FIG. 10 includes theoretically derived graphs of $D_c/g$ as a function of c for obstacles having triangular (equilateral triangle) 910 and circular 912 cross sections. In the graph of FIG. 10, the region above the curves 910 or 912 is associated with particles following an angled trajectory (angled with respect to the direction of ink flow). The region below the curves 910 or 912 is associated with particles following a zigzag trajectory substantially following the direction of the ink flow.

Based on the theoretical data provided in graph 912 in FIG. 10, the design of an obstacle array for an ink jet printer having a basic configuration similar to that of FIGS. 7 and 8 may be described. For example, a particle separator similar to separator 750 may have layer thicknesses on the order of about 25 μm. In this case, assuming the bars 720 are about 25 μm thick and the larger particles of interest are about 10 μm in diameter, $D_c$=10 μm. This gives a particle critical diameter to gap value, 10/25 of 0.4. Based on graph 912, for this example, the row offset fraction, $\epsilon$, is about 0.12. To achieve a displacement of larger particles into the first channel 751 at the top half of the structure of FIGS. 7-8, a displacement of roughly 50 μm is needed. Each "bump" against a bar 720 displaces the larger particles roughly 0.12*25 μm=3 μm. In this illustrative case, about 16 rows of 25 μm obstacles are needed to achieve a displacement of about 50 μm. In this realization, it is possible to use roughly 5 obstacles per row in each of the 16 rows to achieve the desired displacement as described in the aforementioned pressure drop estimate.

Figure 11:
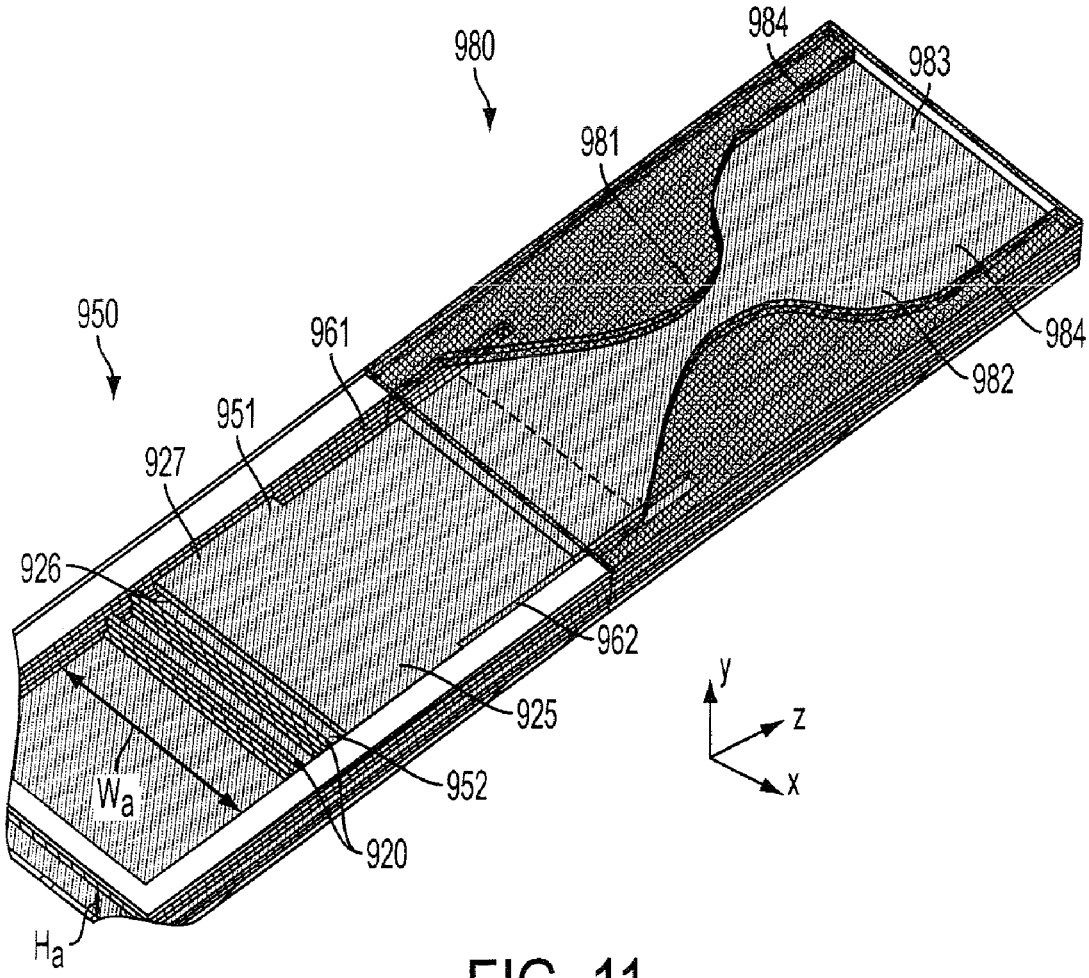
FIG. 11 is an isometric cutaway view of a particle removal device that includes an obstacle array and converging and diverging features.

In some cases, the particle removal device may include multiple separators arranged in series and/or in parallel. A particle removal device that includes multiple series-connected separators is illustrated in FIG. 11. In some cases, multiple series and/or parallel-connected separators may be the same type of separator, e.g., two or more of the separators may be obstacle arrays. In some cases, the multiple series and/or parallel-connected separators may be different types of separators. FIG. 11 shows a particle removal device that includes a first separator 950, which is an obstacle-type separator, and a second separator 980, which in this example includes converging and diverging features configured to separate flow paths carrying larger particles from "clean" ink flow paths by creating hydrodynamic flow patterns with gradually widening streamlines. In some cases, the particle removal device may include only one of each type of separator.

Similarly to the particle separator 750 illustrated in FIGS. 7 and 8, the particle removal device of FIG. 11 is a layered structure. Also, like separator 750, the obstacle type separator 950 includes two rows of obstacles 920 (bars) that extend laterally across the separator 950. The rows of bars 920 are offset from one another as depicted in more detail in FIG. 8.

The offset angle of the rows, and the gap distance between the bars in a row, are configured to divert larger particles with diameters greater than the critical size. The contaminated ink that contains these larger particles is diverted into a first channel 951 which runs along the first surface 927 of elongated obstacle 925. The clean ink that is substantially free of the larger particles flows into a second channel 952 which runs along the second surface 926 of the elongated obstacle 925. As a result of the diversion of the larger particles by the obstacles, the ink flowing in the first channel 951 is rich in larger particles, having a higher concentration of larger particles in comparison with the concentration of larger particles flowing in the second channel 952. The ink flowing in the second channel 952 is a relatively "clean" flow which includes none or few larger particles.

Obstacle-type separators 650, 750, 950 illustrated in FIGS. 6-8 and 11 may by configured to separate particles having dimensions greater than 10 μm from particles having diameters less than 10 μm. The spacings of the arrangement of obstacles may be relatively large in comparison to the size of the particles, mitigating clogging. The larger particles are removed from the ink jet system, whereas the smaller particles e.g., having less than about 10 μm are unlikely to affect jetting function and may not be removed. A separator arranged to achieve this separation can include bars having cross sectional dimensions, w and h, where w is about 30 μm and h is about 30-100 μm. The gap, g, between the bars of a row may be about 12-25 μm. The row shift fraction may be 0.1 or less for a 25 μm bar to bar spacing. As best seen in FIG. 11, the opening to the obstacle separator 950 may have dimensions $W_a \times H_a$ of about 1000 μm×about 250 μm, for example. If formed as a layered structure, each layer may have thickness of about 25 μm.

The particle removal device illustrated in FIG. 11 also includes a second separator 980 used to further separate the larger particles from the clean ink. In some cases, the second separator 980 applies pinched flow fractionation operating on the ink that flows in the first channel 951 which is rich in larger particles. The pinched flow fractionation feature of exemplary separator 980 includes a converging feature 981 that constricts the flow of the ink containing the larger particles along a narrow pathway. After passing through the converging feature 981, the ink flows into a diverging feature 982. When encountering the diverging feature 982, the flow path of the larger particles diverges from the flow path of the smaller particles. Due to their size, larger particles primarily flow in the center region 983 of the diverging feature 982 and smaller particles primarily flow along the edge regions 984 of the diverging feature 982. The larger particles can be routed towards a dump chamber or to a vent. The operation of separators based on converging/diverging features is illustrated in more detail with reference to FIG. 12.

Separator 980 may optionally use a sheath liquid to focus the flow stream into the converging feature 981. In some cases, the sheath liquid may be a portion of the liquid from the "clean" flow that includes a lower concentration of the larger particles. The second separator 980 of FIG. 11 uses the ink flowing in the second channel 952, i.e., the "clean" ink from the first separator 950, as the sheath liquid. FIG. 11 shows inlets 961, 962 on either side of the first channel 951 which are fluidically connected to the second channel 952. The inlets 961, 962 provide an out-of-plane manifold feature on either side of the first channel 951 that allows introduction of the sheath liquid ("clean" ink) from the second channel 952 into the first channel 951 to focus the flow of larger particles in the contaminated ink into the converging feature 981.

Figure 12:
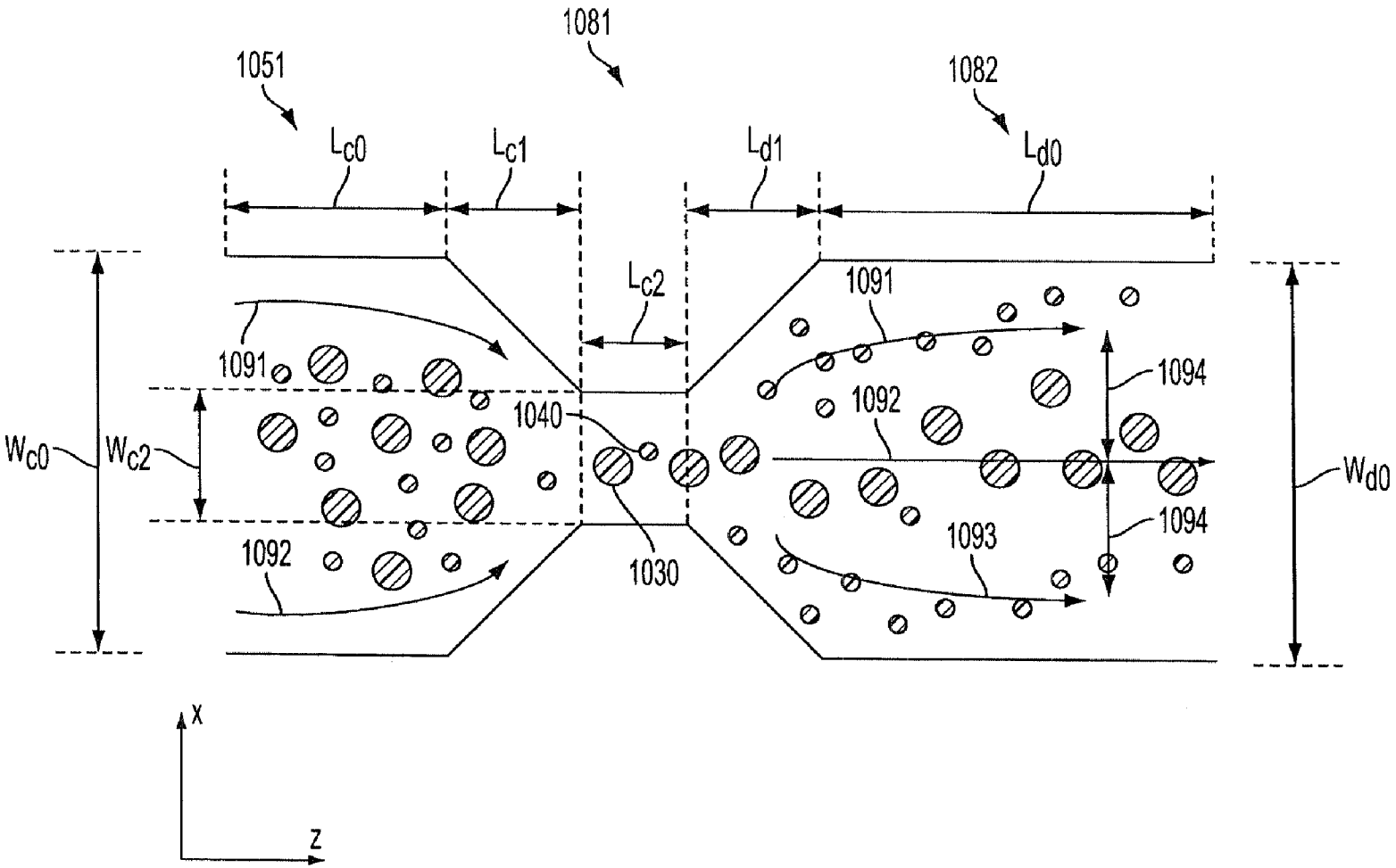
FIG. 12 illustrates the operation of a separator incorporating converging and diverging features.

FIG. 12 further illustrates converging and diverging features 1081, 1082 providing pinched flow fractionation that can be used for particle separation in an ink jet printer. Pinched flow fractionation works on a principle of "streamline amplification". In this case, by focusing particles into a tight band e.g., using a contraction, there are small differences in the streamlines encountered by particles of different size. As the flow goes through the expansion, the streamline differences are amplified and the particles spread deterministically. Note that although the examples of FIGS. 11 and 12 illustrate converging and diverging features, other fluidic arrangements to achieve pinched flow fractionation are possible.

Before encountering the converging feature 1081, ink with mixed larger 1030 and smaller 1040 particles is flowing in an initial channel 1051, having a length $L_{c0}$. The flow path of the ink in the initial channel 1051 may be focused by a sheath liquid 1091, 1092 which is introduced into the initial channel 1051, e.g., on one or both sides of the initial channel 1051. The walls of the channel narrow at the converging feature 1081 for a distance $L_{c1}$, and may maintain the reduced width, $W_{c2}$, for a distance $L_{c2}$. The walls of the channel diverge for a distance, $L_{d1}$, in the diverging feature 1082 until they reach a width, $W_{d0}$, which may be maintained for a length, $L_{d0}$. After constriction of the flow path in the converging feature 1081, the ink diverges in the diverging feature 1082 which causes clean ink which may contain particles smaller than a certain diameter to travel along flow paths 1091, 1093 which are nearer the edges of the diverging channel 1082. The larger particles travel along a flow path 1092 nearer to the center of the channel.

The distance, $D_{pc}$, between the particle flow centers 1094 is given by:

$$D_{pc}=(W_{c0}/W_{c2})*(D_1-D_2)/2,$$

where $W_{c0}$ in this case is equal to $W_{d0}$ and is the width of the broad section, $W_{c2}$ is the width of the pinched section, $D_1$ is diameter of the larger particles, and $D_2$ is the diameter of the smaller particles.

It is desirable for the concentrated larger particle stream to be about 100 μm away from the smaller particle streams. In one example, $D_1$=30 μm and $D_2$=10 μm. In this example, $W_{c0}/W_{c2}$ needs to be about 10:1. The specific size of these dimensions depends on the pressure drop that is tolerable in the contraction. For example, for a 1 cm by 550 μm cross sectional ink jet manifold channel, a 4:1 contraction with a length of 1 mm gives a pressure drop of roughly 80 Pa.

It will be appreciated that examples provided herein, such as those discussed above, are merely illustrative in nature, and that one skilled in the art will understand upon reading this disclosure that various particular pressure drops may be achieved using appropriate obstacle arrays having dimensions that support the various pressure drop constraints for particle sizes of interest.

Figure 13:
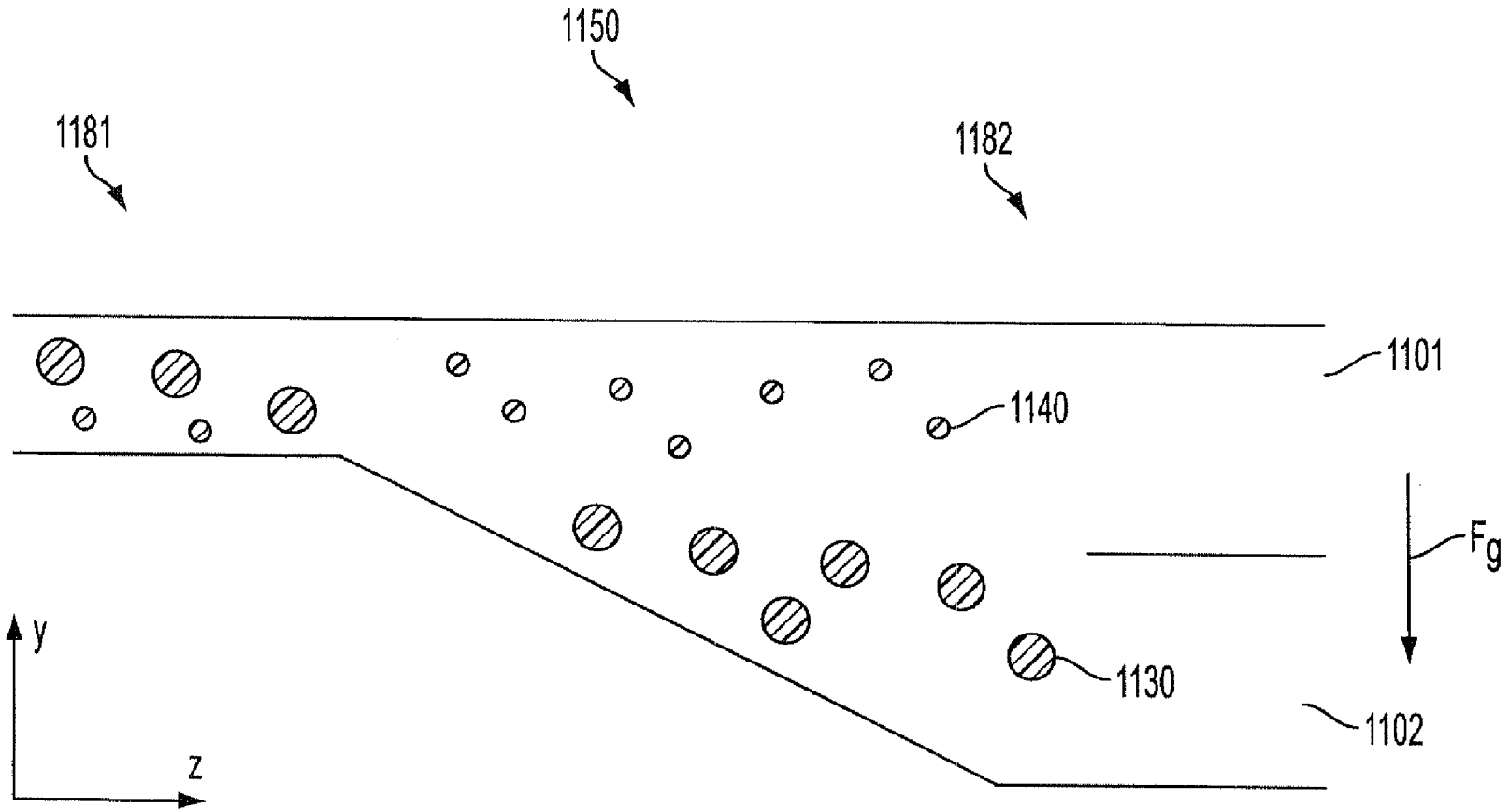
FIG. 13 shows a separator that includes converging and diverging features oriented so that separation of particles is enhanced by the force of gravity.

In some implementations, a separator that includes converging and diverging features may be oriented to provide gravity-enhanced particle separation. FIG. 13 shows a separator 1150 that includes converging 1181 and diverging 1182 features. The separator 1150 is oriented so that the force of gravity, Fg, acts to push the larger particles 1130 towards a bottom channel 1102, whereas the smaller particles 1140, being less affected by Fg, flow through an upper channel 1101. In some cases, diverging flows in both y and x directions may be useful for particle separation. For bubble separation, the arrangement illustrated in FIG. 13 may be reversed, so that the expansion of the channel occurs in a direction opposite to the direction of the force of gravity, Fg, allowing the bubbles to rise and be separated from the clean ink.

Figure 14:
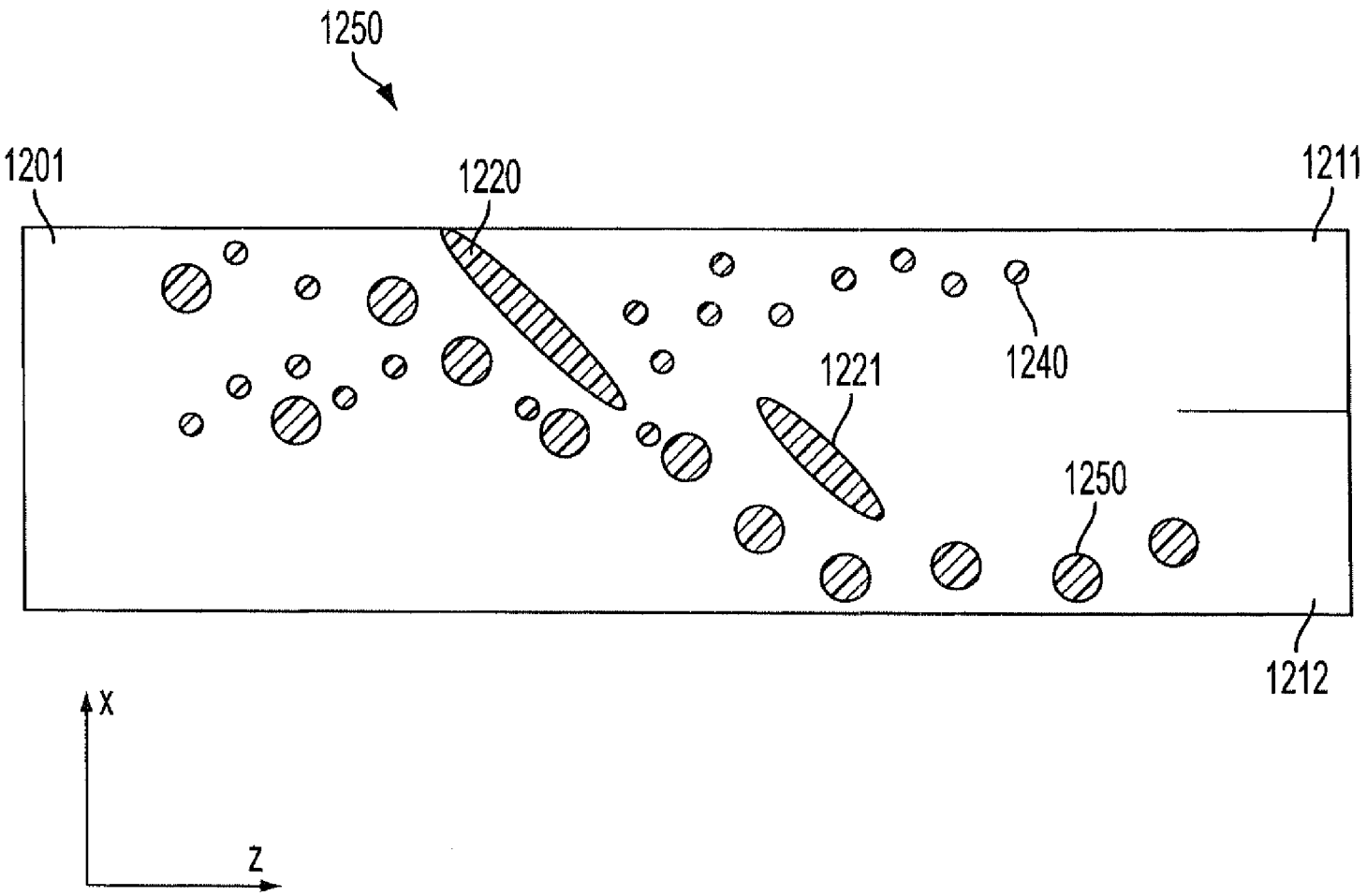
FIG. 14 depicts a configuration of obstacle-type separator which does not utilize an array.

The particle removal device may include a number of separators of various types. FIG. 14 illustrates another example of a separator 1250 that may be implemented in an ink jet printer for particle removal. The separator 1250 includes a tab 1220 and an obstacle 1221 oriented within the separator 1250. For example, in one implementation, the orientation may be as indicated by the axes of FIG. 14, and in plan view, the tab 1220 is attached to a sidewall 1201 of the separator channel and the obstacle 1221 is attached to the separator base.

Figure 15:
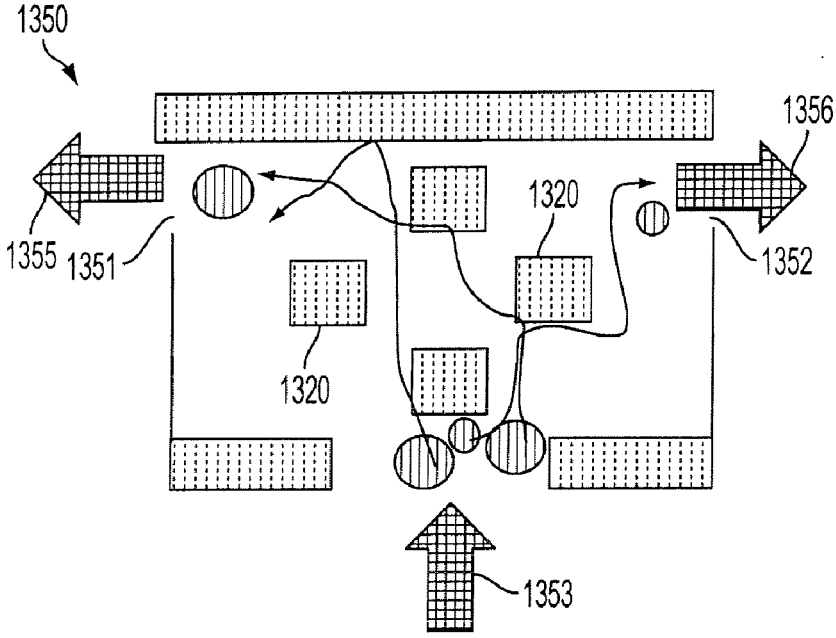
FIGS. 15 and 16 illustrate another arrangement of obstacle array separator.
Figure 16:
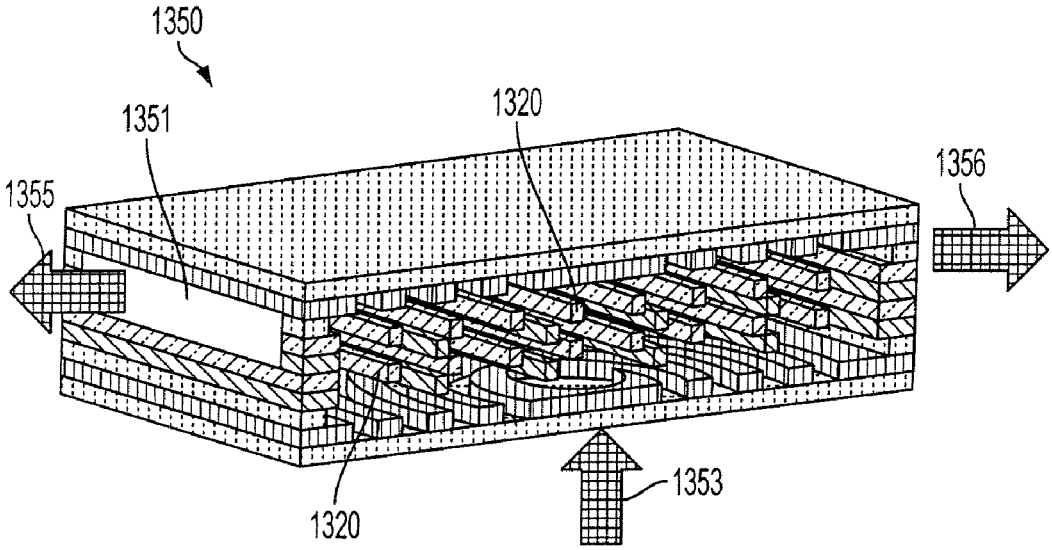

FIGS. 15 and 16 illustrate yet another obstacle-type separator configuration that may be used in an ink jet particle removal device. FIG. 15 is a cross sectional view of the separator 1350 and FIG. 16 is an isometric cutaway view of the separator 1350. As illustrated in FIG. 16, the separator may be formed as a layered structure. In this example, flow paths 1355, 1356 out of the separator 1350 are angled at approximately right angles with respect to the flow path 1353 into the separator 1350. The separator 1350 includes an array of obstacles 1320 which may be configured as an arrangement of bars, as illustrated in FIG. 16. The separator illustrated in FIGS. 15 and 16 can be oriented in a vertical configuration that shifts particles to output channels 1351, 1352 which are formed in one or more layers of a layered structure. The vertical configuration illustrated in FIGS. 15 and 16 can provide a smaller footprint than some horizontal configurations, for example, those depicted in FIGS. 7, 8 and 11.

Each row of bars 1320 is offset from an adjacent row. As previously discussed, the larger particles 1330 travel in flow paths substantially aligned with the angle of offset of the rows toward the output channel 1351. The smaller particles 1340 are minimally diverted by the bars 1320 and travel toward both output channels 1351, 1352. In this particular configuration, the large and small particles 1330, 1340 collide with the top 1357 of the separator 1350. As a result of the diversion of the larger particles 1330 by the obstacle array, the liquid flowing from output channel 1351 has a higher concentration of larger particles 1330 than the liquid flowing from output channel 1352. Liquid flowing through the output channels 1351, 1352 may be shunted or used in other operations. For example, the liquid having the higher concentration of larger particles 1330 flowing through output channel 1351 may be shunted to a waste area. The clean liquid having a lower concentration of the large particles 1330 flowing through output channel 1352 may be used for ink jet operations.

A particle removal device may include multiple separators arranged in series and/or parallel. Series connected separators may be used to implement multiple stage particle removal, each stage removing additional particles and/or removing particles of successively smaller sizes. Parallel connected separators may be implemented, for example, to avoid excessive pressure drops, e.g., greater than about 100 Pa, in the ink flow path which would cause disruptions in ink jetting. A particle removal device may use some separators arranged in parallel and some separators arranged in series. Contaminated ink that incorporates the larger particles can be routed through a waste channel and discarded. Ink which has been cleaned of particles above a certain size can exit through a separate channel and eventually routed to the ink jets of the printer.

Figure 17:
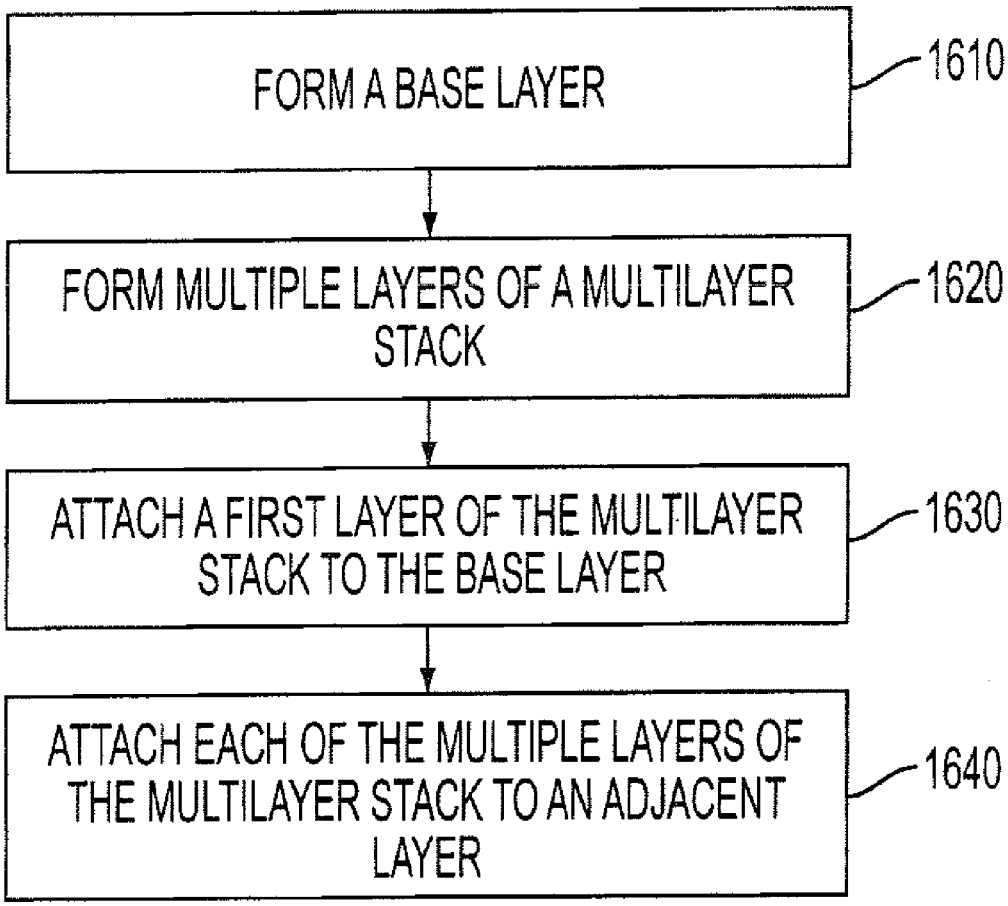
FIG. 17 is a flow diagram illustrating a method of making a particle removal device.

The separators discussed herein may be manufactured as single layer or multiple layer structures. FIGS. 7, 8, 11 and 16 show separators which have been formed as layered structures. As previously discussed, the layered structure may include a base layer, a multi-layer stack which forms the obstacles of the obstacle arrangement, and a cover. FIG. 17 is a flow diagram illustrating a method for making a layered particle removal device. The method includes forming 1610, 1620 the various layers of the device, including, for example, a base layer and each of the multiple layers of the multi-layer stack. In some cases, each of the layers of the multi-layer stack form an obstacle of the separator, e.g., a bar that extends across the separator as previously discussed. In some implementations, the multi-layer stack may form converging and diverging features as illustrated in FIG. 11. The layers may be made of any suitable material, such as metal or plastic by methods such as laser cutting, punching, machining, etching, deposition, molding, and/or printing. The layers can be attached together 1630, 1640 by any suitable method, e.g., any combination of laminating, diffusion bonding, plasma bonding, adhesives, welding, chemical bonding, and mechanical joining.

Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

Various modifications and additions can be made to the preferred embodiments discussed above. Accordingly, the scope of the present disclosure should not be limited by the particular embodiments described above, but should be defined only by the claims set forth below and equivalents thereof.

What is claimed is:

1. A layered device for separating particles from ink, comprising:

a base layer;

a layered stack disposed on the base layer, the layered stack arranged in an ink jet printer and forming a separator that includes a first channel, a second channel, and an arrangement of bars comprising at least two rows of bars, the bars extending laterally with respect to a flow path of the ink in the first separator, the rows of bars offset from one another by an offset fraction, the arrangement of bars configured to preferentially route larger particles having diameters greater than a critical diameter through the arrangement into the first channel along a first trajectory that is angled with respect to the flow path of the ink, an angle of the first trajectory being a function of the offset fraction, and to route smaller particles having diameters smaller than the critical diameter into the first channel or the second channel along a second trajectory that is not substantially angled with respect to the flow path of the ink; and a cover layer.

2. The layered device of claim 1, wherein the arrangement is configured to maintain a pressure drop of the ink of less than about 100 Pa in the separator.

3. The layered device of claim 1, wherein the arrangement comprises between about 2 and about 10 rows of bars.

4. The layered device of claim 1, wherein the particles comprise air bubbles.

5. A method of making a device for removing particles from ink in an ink jet printer, comprising;

forming a base layer and a cover layer; and disposing a multi-layer stack on the base layer; and arranging each layer of the multi-layer stack relative to an adjacent layer of the multi-layer stack, each layer of the multi-layer stack forming at least one bar of an arrangement of bars, the arrangement of bars forming a separator that includes at least two rows of bars, the bars extending laterally across the separator, the rows of bars offset from one another by an offset fraction, the arrangement of bars configured to preferentially route larger particles through the arrangement along a first trajectory that is angled with respect to the flow path of the ink, an angle of the first trajectory being a function of the offset fraction, and to route smaller particles through the arrangement along a second trajectory that is not substantially angled with respect to the flow path of the ink.

6. The method of claim 5, wherein forming the base layer and the multiple layers comprises one or more of chemical etching, laser cutting, punching, machining, and printing.

7. The method of claim 5, wherein attaching the base layer and the multiple comprises one or more of diffusion bonding, plasma bonding, adhesives, welding, chemical bonding, and mechanical joining.

8. The device of claim 1, further comprising an additional separator fluidically coupled to the separator, the additional separator including a pinched flow fractionation feature configured to further separate the larger particles from the smaller particles.

9. The device of claim 8, wherein the additional separator comprises:

a converging feature;

a diverging feature; and one or more focusing inlets configured to allow a portion of ink that is substantially free of the larger particles flowing in the second channel to provide a sheath liquid that joins ink that includes the larger particles flowing in the first channel.

10. The device of claim 1, wherein the offset fraction is in a range of about 0.1 to about 0.25.

11. The device of claim 10, wherein the critical diameter is in a range of about 10 μm to about 20 μm.

12. The device of claim 10, wherein a cross sectional dimension of the bar is about 25 μm.

13. The device of claim 10, wherein a gap between bars in a row is greater than about 1.5 times the critical diameter.

* * * * *